US007744517B2

(12) United States Patent
Bonenfant

(10) Patent No.: US 7,744,517 B2
(45) Date of Patent: Jun. 29, 2010

(54) TAMPER-INDICATING RESEALABLE CLOSURE

(75) Inventor: Daniel M. Bonenfant, Amherst, NH (US)

(73) Assignee: Kraft Foods Global Brands LLC, Northfield, IL (US)

( * ) Notice: Subject to any disclaimer, the term of this patent is extended or adjusted under 35 U.S.C. 154(b) by 0 days.

(21) Appl. No.: 12/118,935

(22) Filed: May 12, 2008

(65) Prior Publication Data

US 2008/0214376 A1 Sep. 4, 2008

Related U.S. Application Data

(62) Division of application No. 10/897,712, filed on Jul. 23, 2004, now Pat. No. 7,371,008.

(51) Int. Cl.
*B31B 1/14* (2006.01)

(52) U.S. Cl. ..... 493/223; 493/377; 493/213

(58) Field of Classification Search ..... 493/223, 493/394, 377, 378, 927, 213, 114; 428/40.1, 428/42.1, 42.2, 914; 206/807; 383/5, 210, 383/211; 229/87.05, 81

See application file for complete search history.

(56) References Cited

U.S. PATENT DOCUMENTS

| | | | |
|---|---|---|---|
| 1,171,462 | A | 2/1916 | Rice |
| 2,128,196 | A | 8/1938 | Vogel |
| 3,127,273 | A | 3/1964 | Monoham |
| 3,235,165 | A | 2/1966 | Jackson |
| 3,272,422 | A | 9/1966 | Miller |
| 3,618,751 | A | 11/1971 | Rich |
| 3,740,238 | A | 6/1973 | Graham |
| 3,885,727 | A | 5/1975 | Gllley |

(Continued)

FOREIGN PATENT DOCUMENTS

| | | |
|---|---|---|
| DE | 9014065.6 | 4/1991 |

(Continued)

OTHER PUBLICATIONS

Reclosure system lengthens food life, Packaging News PPMA Preview, Sep. 2001, p. 40.

(Continued)

*Primary Examiner*—Sameh H. Tawfik
(74) *Attorney, Agent, or Firm*—Fitch, Even, Tabin & Flannery

(57) ABSTRACT

A tamper indicating, resealable closure for a package includes first and second film layers releasably adhesively joined together such that the first and second film layers are at least partially separable when the second film layer is pulled away from the first film layer. The first film layer includes first and second tear lines formed thereon to define first and second panel sections respectively. The first panel section defines an access opening through the first film layer when it is separated along the first tear line during an initial separation of the first and second film layers. The second panel section also becomes separated from the first film layer when the second film layer is separated from the first film layer to provide an indication of an initial opening of the closure. Subsequently, the second film layer may be re-adhered to the first film layer to reseal the access opening, while the second panel section remains separated from the first film layer.

5 Claims, 4 Drawing Sheets

U.S. PATENT DOCUMENTS 3,910,410 A 10/1975 Shaw
3,938,659 A 2/1976 Wardwell
3,966,046 A 6/1976 Deutschlander
4,156,493 A 5/1979 Julius
4,185,754 A 1/1980 Julius
4,197,949 A * 4/1980 Carlsson ..... 229/229
4,258,876 A 3/1981 Ljungerantz
4,260,061 A 4/1981 Jacobs
4,273,815 A 6/1981 Gifford et al.
4,397,415 A 8/1983 Lisiecki
4,411,365 A 10/1983 Horikawa et al.
4,420,080 A 12/1983 Nakamura
4,464,154 A 8/1984 Ljungerantz
4,548,824 A 10/1985 Mitchell et al.
4,548,852 A 10/1985 Mitchell
4,549,063 A 10/1985 Ang et al.
4,552,269 A 11/1985 Chang
4,610,357 A 9/1986 Nakamura
4,625,495 A 12/1986 Holavach
4,648,509 A 3/1987 Alves
4,651,874 A 3/1987 Nakamura
4,653,250 A 3/1987 Nakamura
4,671,453 A 6/1987 Cassidy
4,673,085 A 6/1987 Badouard et al.
4,679,693 A * 7/1987 Forman ..... 383/203
4,694,960 A 9/1987 Phipps et al.
4,723,301 A 2/1988 Chang
4,738,365 A 4/1988 Prater
4,784,885 A 11/1988 Carespodi
4,790,436 A * 12/1988 Nakamura ..... 206/449
4,798,295 A 1/1989 Rausing
4,798,296 A 1/1989 Lagerstedt et al.
4,799,594 A 1/1989 Blackman
4,840,270 A 6/1989 Caputo et al.
4,845,470 A 7/1989 Boldt, Jr.
4,848,575 A 7/1989 Nakamura et al.
4,865,198 A 9/1989 Butler
4,866,911 A 9/1989 Grindrod et al.
4,874,096 A 10/1989 Tessera-Chiesa
4,876,123 A 10/1989 Rivera et al.
4,917,247 A 4/1990 Jud
4,943,439 A 7/1990 Andreas et al.
4,972,953 A 11/1990 Friedman et al.
5,000,320 A 3/1991 Kuchenbecker
5,029,712 A 7/1991 O'Brien et al.
5,048,718 A 9/1991 Nakamura
5,065,868 A 11/1991 Cornelissen et al.
5,076,439 A 12/1991 Kuchenbecker
5,077,064 A 12/1991 Hustad et al.
5,082,702 A 1/1992 Alband
5,100,003 A 3/1992 Jud
5,103,980 A 4/1992 Kuchenbecker
5,124,388 A 6/1992 Pruett et al.
5,158,499 A 10/1992 Guckenberger
5,167,974 A 12/1992 Grindod et al.
5,174,659 A 12/1992 Laske
5,197,618 A 3/1993 Goth
5,344,007 A 9/1994 Nakamura et al.
5,375,698 A 12/1994 Ewart et al.
5,388,757 A 2/1995 Lorenzen
5,405,629 A 4/1995 Marnocha et al.
5,407,070 A 4/1995 Bascos et al.
5,464,092 A 11/1995 Seeley
5,499,757 A 3/1996 Back
5,503,858 A 4/1996 Reskow
5,520,939 A 5/1996 Wells
5,524,759 A 6/1996 Herzberg et al.
5,531,325 A 7/1996 Delflander et al.
5,538,129 A 7/1996 Chester et al.
5,582,853 A 12/1996 Marnocha et al.
5,582,887 A 12/1996 Etheredge
5,591,468 A 1/1997 Stockley, III et al.
5,633,058 A 5/1997 Hoffer et al.
5,647,506 A 7/1997 Julius
5,664,677 A 9/1997 O'Connor
5,688,394 A 11/1997 McBride, Jr. et al.
5,702,743 A 12/1997 Wells
5,725,311 A 3/1998 Ponsi et al.
D394,605 S 5/1998 Skiba et al.
5,791,465 A 8/1998 Niki et al.
5,795,604 A 8/1998 Wells et al.
5,826,101 A 10/1998 Haas et al.
5,833,368 A 11/1998 Kaufman
5,873,483 A 2/1999 Gortz et al.
5,882,116 A 3/1999 Backus
5,908,246 A 6/1999 Arimura et al.
5,928,749 A 7/1999 Forman
5,938,013 A * 8/1999 Palumbo et al. ..... 206/210
5,945,145 A 8/1999 Narsutis et al.
5,956,794 A 9/1999 Skiba et al.
5,997,177 A 12/1999 Kaufman
6,026,953 A * 2/2000 Nakamura et al. ..... 206/233
6,029,809 A 2/2000 Skiba et al.
6,056,141 A 5/2000 Navarini et al.
6,065,591 A 5/2000 Dill et al.
6,113,271 A 9/2000 Scott et al.
6,126,009 A 10/2000 Shiffler et al.
6,164,441 A * 12/2000 Guy et al. ..... 206/210
D447,054 S 8/2001 Hill
6,273,610 B1 8/2001 Koyama et al.
6,296,884 B1 10/2001 Okerlund
6,309,105 B1 * 10/2001 Palumbo ..... 383/211
6,318,894 B1 11/2001 Derenthal
6,364,113 B1 4/2002 Faasse, Jr. et al.
6,383,592 B1 5/2002 Lowry et al.
6,420,006 B1 7/2002 Scott
6,428,867 B1 * 8/2002 Scott et al. ..... 428/40.1
6,450,685 B1 9/2002 Scott
6,457,585 B1 10/2002 Huffer et al.
6,461,043 B1 10/2002 Healy et al.
6,461,708 B1 10/2002 Dronzek
6,517,243 B2 2/2003 Huffer et al.
6,554,134 B1 4/2003 Guibert
6,589,622 B1 * 7/2003 Scott ..... 428/40.1
6,691,886 B1 2/2004 Berndt et al.
6,726,054 B2 4/2004 Fagen et al.
6,746,743 B2 6/2004 Knoerzer et al.
6,865,860 B2 3/2005 Arakawa et al.
6,918,532 B2 * 7/2005 Sierra-Gomez et al. .. 229/87.08
6,983,875 B2 1/2006 Emmott
7,007,423 B2 3/2006 Andersson et al.
7,032,757 B2 4/2006 Richards et al.
7,344,744 B2 * 3/2008 Sierra-Gomez et al. ..... 426/119
7,350,688 B2 4/2008 Sierra-Gomez et al.
2002/0182359 A1 * 12/2002 Muir et al. ..... 428/40.1
2003/0039412 A1 2/2003 Rodick
2003/0118255 A1 6/2003 Miller
2003/0183637 A1 10/2003 Zappa et al.
2003/0210838 A1 11/2003 Steele
2003/0223656 A1 12/2003 Razeti et al.
2004/0011677 A1 1/2004 Arakawa et al.
2004/0062838 A1 4/2004 Castellanos et al.
2004/0067326 A1 * 4/2004 Knoerzer et al. ..... 428/34.1
2004/0083680 A1 5/2004 Compton et al.
2004/0180118 A1 9/2004 Renger et al.
2005/0000965 A1 1/2005 Boardman
2005/0276525 A1 12/2005 Hebert
2006/0066096 A1 3/2006 Kan
2006/0257599 A1 11/2006 Exner et al.
2007/0023435 A1 2/2007 Sierra-Gomez et al.
2007/0095709 A1 5/2007 Saito et al.
2007/0209959 A1 9/2007 Burgess
2007/0275133 A1 11/2007 Sierra-Gomez et al.
2008/0037911 A1 2/2008 Cole et al.

FOREIGN PATENT DOCUMENTS

| | | |
|---|---|---|
| EP | 0474981 | 3/1992 |
| EP | 0629561 | 12/1994 |
| EP | 0661154 | 7/1995 |
| EP | 0796208 | 9/1997 |
| EP | 0905048 | 3/1999 |
| EP | 1375380 | 1/2004 |
| EP | 1437311 | 7/2004 |
| EP | 1477425 | 11/2004 |
| EP | 1468936 | 10/2009 |
| FR | 1327914 | 4/1963 |
| GB | 2276095 | 9/1994 |
| JP | 09156677 | 6/1997 |
| JP | 2000335542 | 12/2000 |
| WO | 02/066341 | 8/2002 |
| WO | 03/013976 | 2/2003 |
| WO | 03/059776 | 7/2003 |

OTHER PUBLICATIONS

Patent Abstracts of Japan, vol. 1997 No. 10, Oct. 31, 1997 and JP09156677 A (Fuji Seal Co. Ltd.) (Jul. 6, 1997) abstract in English and 7 figures.

"Elite Edam Cheese", Mintel gnpd, Dec. 3, 2001, Mintel Publishing.

"New Easy Peel Cheese Packaging", Mintel gnpd, Aug. 10, 2001, Mintel Publishing.

"Cheese Range", Mintel gnpd, Jan. 26, 2001, Mintel Publishing.

"Soft Bread Sticks", Mintel gnpd, Mar. 20, 1998, Mintel Publishing.

"New on the Shelf-Product Instructions and Packaging Trends", Circle Reader Service Card No. 93, Aug. 1998, Baking & Snack.

Reseal-it. [Homepage of Macfarlane Group] [Online] 2005. Available at: http//www.real-it.se [accesed Mar. 14, 2005].

Machinery Update, Mar./Apr. 2002, pp. 59-60.

Giant Baby Wipes package, item No. 80203-91, resealable package having die cut-out portions (tabs) which remain affixed to the top of the package after label is withdrawn from the top, whereby tamper evidence is indicated by a misalignment of the die cut-out portions with the holes formed in the label.

* cited by examiner

TAMPER-INDICATING RESEALABLE CLOSURE

CROSS REFERENCE TO RELATED APPLICATIONS

This application is a divisional of Application Ser. No. 10/897,712, filed Jul. 23, 2004 (which is hereby incorporated by reference), now U.S. Pat. No. 7,371,008.

FIELD OF INVENTION

The present invention relates generally to packages for storing articles, and more particularly to a tamper-indicating, resealable closure for such packages.

BACKGROUND OF THE INVENTION

Many products are supplied in sealed bags, pouches or other packages formed from thin films or other flexible materials. For example, foodstuffs, tobacco products, small parts or loose items such as pharmaceuticals or medical accessories are commonly provided in pouches or bags formed from flexible film material. Many of these types of packages are provided with tear strips that facilitate opening the package. Moreover, it is known to provide resealing capability to such packages through the use of an adhesive disposed on a portion of the flexible package material that has been separated by the tear strip.

In some applications, it is desired to further construct the package or pouch to provide an indication of initial opening so that any tampering with the package or its contents may be discovered. Conventional tampering indicating devices include printed tapes that can be applied to the package and which are configured to reveal a message in the form of textural indicia, patterns or symbols when the tape seal is initially broken. Incorporation of such tamper indicating tapes increases the time and expense of manufacturing such packages.

Previous resealable packages have been constructed from two layers of flexible film material that are joined together. The first layer defines the outer packaging material and the second forms a panel or flap that can be separated from the first layer to expose an opening in the package. The first and second film layers typically are printed with graphics and indicia to indicate the contents of the package. One drawback of this type of packaging arrangement is that the first and second layers must be precisely registered prior to joining the layers, so that the printed indicia and graphics are in proper alignment on the finished package. The need to precisely register the film layers imposes additional requirements for automated packaging lines and may limit the operating speed of the equipment. Moreover, high scrap rates can result when the film layers drift out of register during operation.

A need therefore exists for a tamper-indicating resealable closure that does not increase the cost of packaging and which can easily be incorporated into the flexible materials used to form pouches, bags or other flexible packages.

SUMMARY OF THE INVENTION

The present invention provides a tamper-indicating resealable closure that can be readily incorporated in to the outer film material of a bag, pouch, or other flexible package. The closure is formed directly on the film material and does not require precise registration of individual layers to align graphics or textual indicia. Moreover, the closure provides an easily identifiable visual indication of initial opening, without requiring pre-printed tamper-indicating tapes to be added to the packaging material.

In one embodiment, the closure comprises first and second film layers that are releasably adhesively joined together so that the second film layer can be peeled back, or otherwise separated, from the first film layer. The first film layer forms the outer portion of the package and the second film layer is transparent, whereby graphics and textual indicia printed on the first film layer are visible through the second film layer. The closure further includes first and second tear lines formed into the first film layer beneath the second film layer. The first tear line defines a first panel section that creates an access opening through the first film layer when the second film layer is peeled back. The second tear line defines a second panel section that serves to indicate the initial opening of the package.

When the second film layer is peeled back, the first and second panel sections, which are adhesively secured to the second film layer, separate from the first film layer, along the first and second tear lines, respectively. The second tear line is configured such that a portion of the second panel section remains integrally joined to the first film layer, and the second panel section eventually becomes separated from the second film layer upon opening the closure. In another embodiment, the first film layer is formed such that the second panel section is biased to move in a direction away from the second film layer after it has separated from the first and second film layers. Accordingly, when the second film layer is repositioned against the first film layer to re-seal the package, the absence of the second panel creates a void that provides a visual indication of initial opening.

Still other embodiments, examples, features, aspects, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

BRIEF DESCRIPTION OF THE DRAWINGS

While the specification concludes with claims which particularly point out and distinctly claim the invention, it is believed the present invention will be better understood from the following description taken in conjunction with the accompanying drawings, in which like reference numerals identify the same elements and in which:

DETAILED DESCRIPTION

Figure 1:
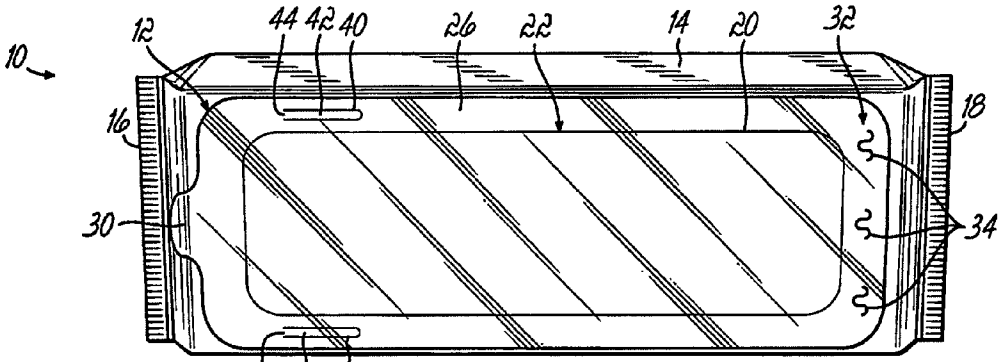
FIG. 1 is a perspective view of a package including an exemplary closure according to the present invention.

Referring to FIG. 1, there is shown a package 10 including an exemplary tamper-indicating, resealable closure 12 according to the present invention. The outer portion of the package 10 includes a first film layer 14, formed from polymeric film or other flexible material, that has been cut, folded, or otherwise processed to define an interior space or receptacle for receiving the product or items to be provided within the package 10. In the embodiment, the longitudinal ends 16, 18 of the package 10 are sealed to enclose the contents of the package 10. This type of packaging is conventionally used to store and distribute foodstuffs such as cookies, crackers and candy, or other items such as tissues or medical wipes. While not depicted in FIG. 1, the first film layer 14 may include graphic or other indicia that identify the contents of package 10.

The exemplary closure to 12 is formed directly on the first film layer 14 and includes a first tear line 20 formed into the first film layer 14. The first tear lined 20 defines a first panel 22 that may be separated from the first film layer 14, along the tear line 20, to expose an opening 24 (see FIG. 4) whereby access to the contents of the package 10 may be gained. The closure 12 further includes a second film layer 26 disposed on top of the first film layer 14 and extending beyond the periphery of the first tear line 20 to thereby cover the first panel section 22. The side of the second film layer 26 that faces the first film layer 14 is coated with an adhesive 28 (see FIGS. 3-5) so that the second film layer 26 may be releasably secured to the first film layer 14. The adhesive-coated second film layer 26 helps to keep the first panel section 22 joined to the first film layer 14 until it is desired to open the package 10.

In the embodiments shown and described herein, the second film layer 26 is provided with a tab 30 or other gripping feature, which is not coated with adhesive 20, so that the second film layer 26 may be peeled back from the first film layer 14 to open the package 10. The second film layer 26 may further include a hinge portion 32, depicted in FIGS. 1 and 2 as a series of undulating die cuts 34 formed through the second film layer 26 along a peripheral edge positioned opposite the tab 30. As the second film layer 26 is peeled back, the undulating die cuts 34 help to keep the edge of the second film layer 26 adhesively secured to the first film layer 14, while permitting the second film layer 26 to be moved away from the access opening 24 to facilitate access to the contents of the package 10. While the hinge portion has been shown and described herein as comprising as series of undulating due cuts 34, it will be recognized that the hinge portion 32 may comprise a fold line defining a living hinge, or any other arrangement suitable for hingedly coupling the second film layer 26 to the first film layer 14.

Figure 2:
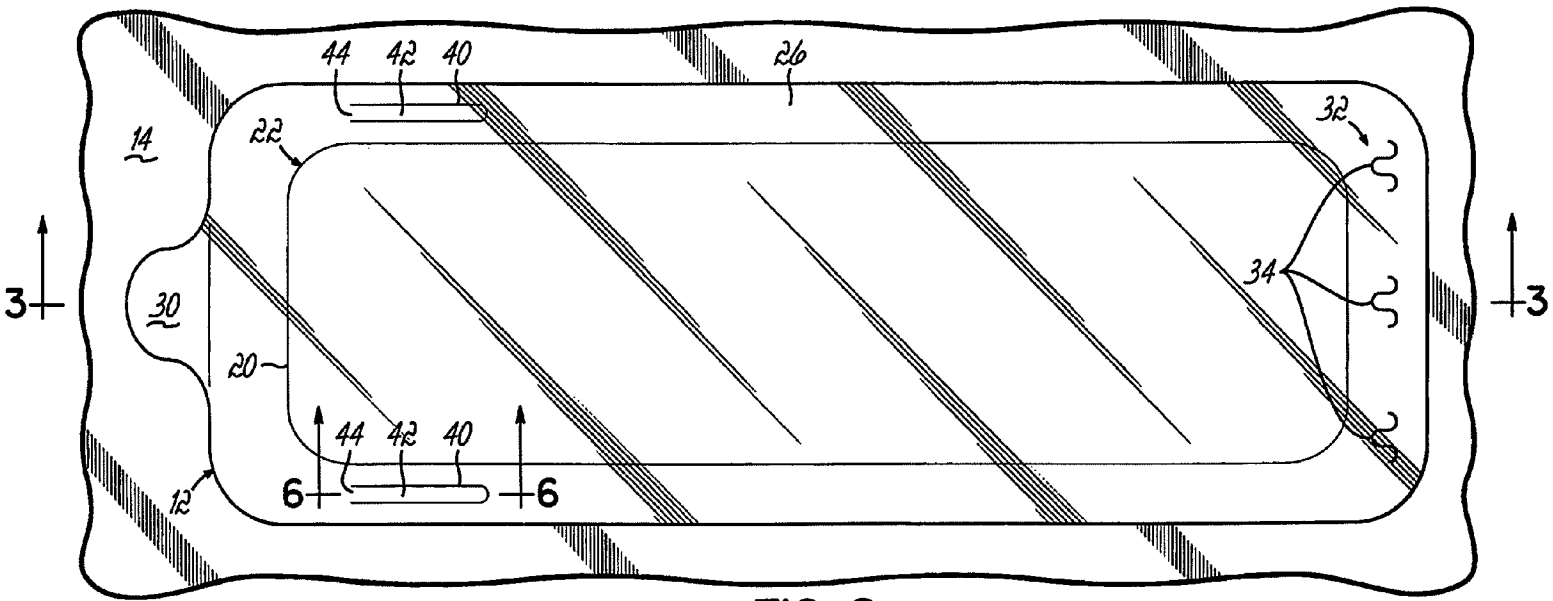
FIG. 2 is an enlarged plan view of the closure depicted in FIG. 1.
Figure 3:
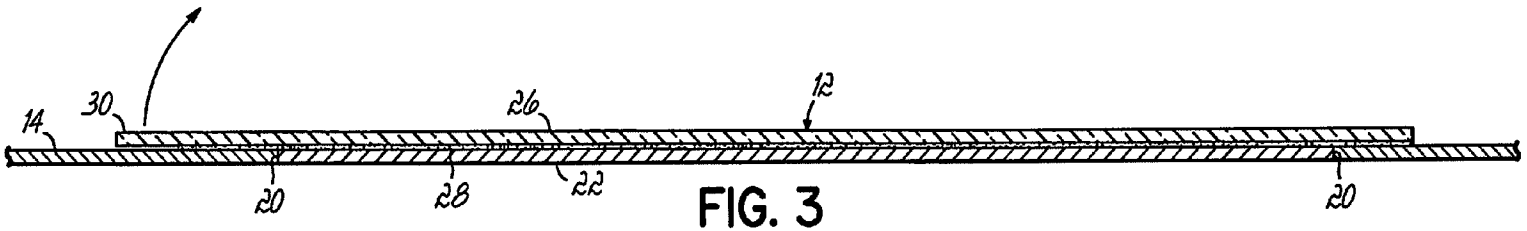
FIG. 3 is a cross-sectional view of the closure of FIG. 2, taken along line 3-3.
Figure 4:
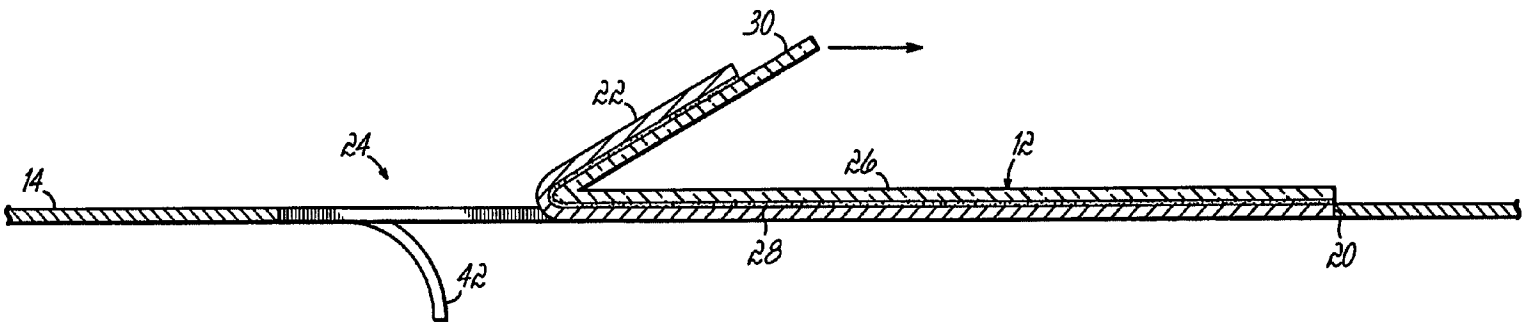
FIG. 4 is a cross-sectional view of the closure of FIG. 3, depicting an initial opening of the closure.
Figure 5:
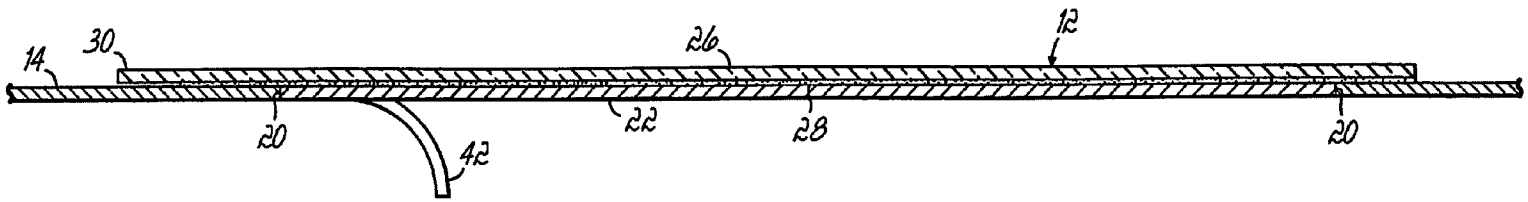
FIG. 5 is a cross-sectional view of the closure of FIG. 3, depicting a resealed configuration of the closure after the initial opening.

With continued reference to FIGS. 1 and 2, and referring further to FIGS. 3 and 4, the first panel section 22 is separated from the first film layer 14 along the first tear line 20 and remains adhered to the second film layer 26 as the second film layer 26 is peeled back to open the package 10. After the contents of the package 10 have been accessed and is it desired to reseal the package 10, the second film layer 26 may be reapplied to the first film layer 14, approximately in its original position, as depicted in FIG. 5. Because the second film layer 26 extends beyond the periphery of the first panel section 22, the adhesive 28 disposed thereon facilitates resealing the package 10 with the first panel section 22 positioned over the access opening 24.

Advantageously, the second film layer 26 may be formed from a transparent film material whereby the graphics and other indicia on the first film layer 14 may be readily viewed through the second film layer 26. When the second film layer 26 is transparent, it will be recognized that a transparent adhesive should also be selected, so as not to detract from the aesthetics of the first film layer graphics and indicia. Such a construction permits the closure 12 to be formed directly on the first film layer 14 without requiring corresponding graphics to be formed on the second film layer 26, and without requiring precise registration between the first and second film layers 14, 26.

Figure 7:
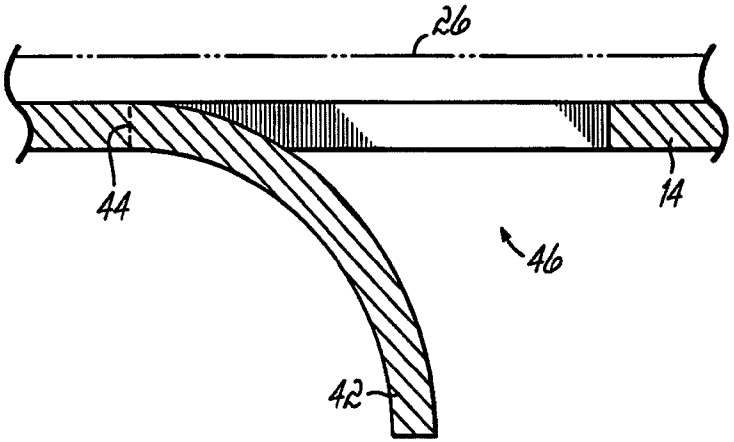
FIG. 7 is a cross sectional view of the closure depicted in FIG. 6, after an initial opening of the closure.
Figure 6:
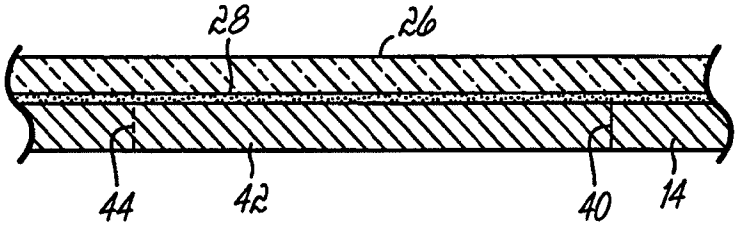
FIG. 6 is an enlarged cross-sectional view of the closure of FIG. 2, taken along line 6-6.
Figure 8:
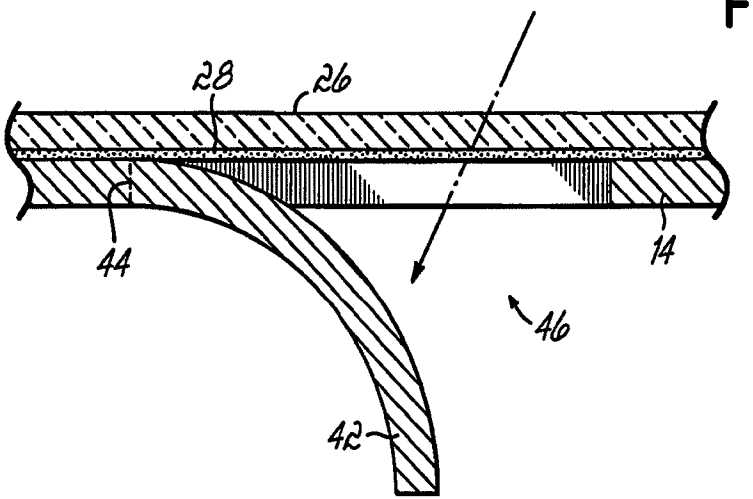
FIG. 8 is a cross-sectional view of the closure of FIGS. 6 and 7, depicting a resealed condition of the closure.

With continued reference to FIGS. 1-5, and referring further to FIGS. 6-8, the closure 12 further includes at least one second tear line 40 formed into the first film layer 14, adjacent the first tear line 20 and outside the periphery of the first panel section 22. In the embodiment shown, the second tear line 40 has a generally elongated u-shape such that a second panel section 42 formed by the second tear line 40 remains integrally joined with the first film layer 14 along one side of the panel. Accordingly, when the second film layer 26 is peeled away from the first film layer 14 to separate the first panel section 22, a portion of the second panel section 42 is separated from the first film layer 14, but the integrally joined portion 44 of the second panel 42 ensures that the second panel 42 does not become completely separated from the first film layer 14. The second panel 42, therefore, remains attached to the first film layer 14, and eventually becomes separated from the adhesive-coated second film layer 26 as the second film layer 26 is peeled back.

Figure 9:
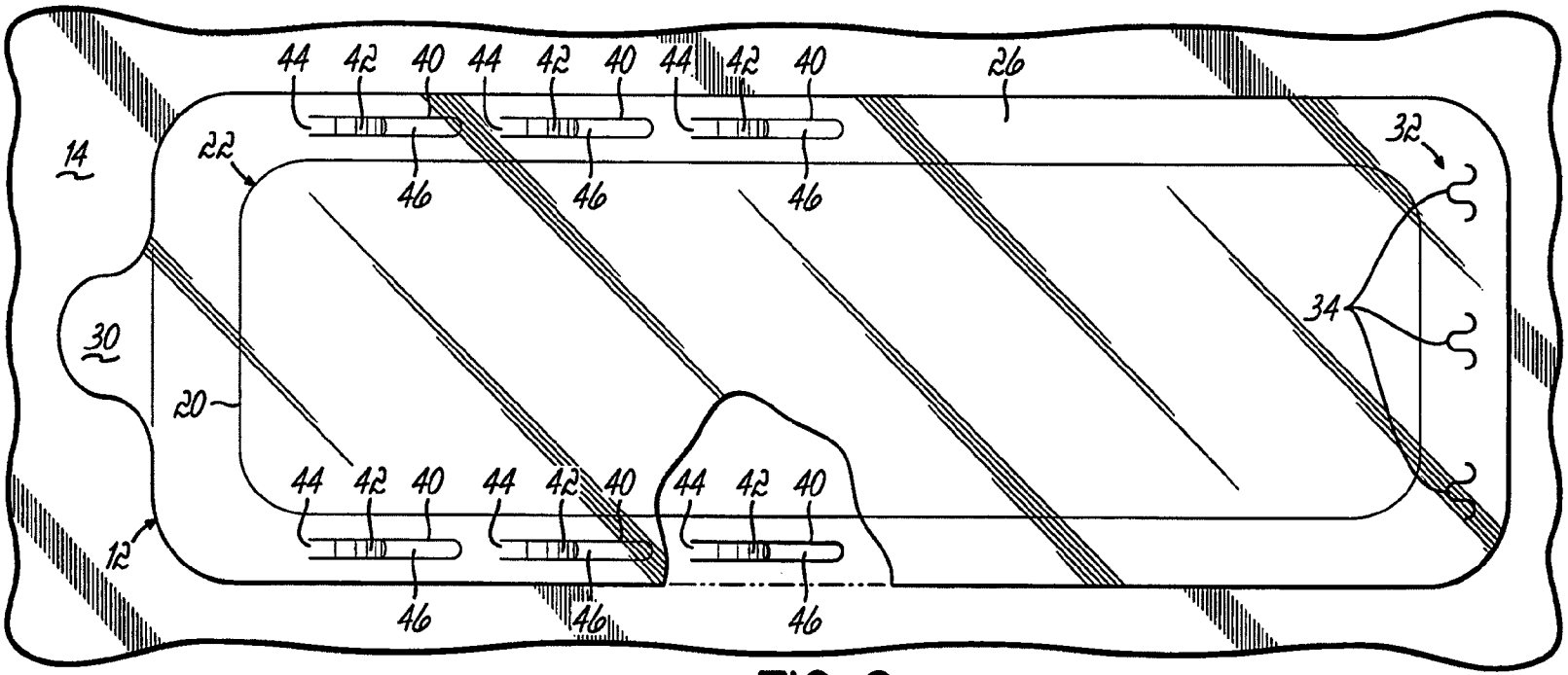
FIG. 9 is a plan view of another embodiment of a closure according to the present invention.

In another embodiment, the material of the first film layer 14 is formed such that the second panel section 42 is biased to move in a direction away from the second film layer 26, and inwardly of the package 10, when it becomes separated from the first and second film layers 14, 26, as depicted in FIGS. 4 and 7. Thereafter, the second panel section 42 provides a visual indication of an initial opening of the package 10, even when the second film layer 26 is resealed against the first film layer 14 to reclose the package 10. Specifically, the second panel section 42 remains joined to the first film layer 14 at one end while the remainder of the second panel section 26 extends downwardly into the package 10, as depicted in FIGS. 4, 5, 7 and 8, to create a void area 46 that is visually detectable when viewing the package 10, as depicted in FIG. 9. Because the second panel section 26 remains joined at one end to the first film layer 14, the second panel section 26 remains tethered to the package 10 and will not become intermingled with the contents therein.

While FIGS. 1 and 2 show and describe two second panel sections 42 having a generally elongate shape, it will be recognized that the closure 12 may alternatively have only one second panel section 42 for indicating an initial opening of the package 10, or several second panel sections 42, as depicted in FIG. 9. Moreover, it will be recognized that the second panel section 42 may have shapes or configurations other than the elongate panel section shown and described herein.

The first film layer 14 may be formed from polypropylene, polyethylene, cellophane, or any other polymeric material suitable for forming a package enclosure. Likewise, the second film layer 26 may be formed from polypropylene, polyethylene or any other polymeric material suitable for forming a selectively releasable and resealable cover that can be adhered to the first film layer 14, as described above. When the package 10 will contain foodstuffs, the adhesive 28 material should be an adhesive approved by the U.S. Food and Drug Administration, or equivalent agency, for such use. Otherwise the adhesive 28 may be any adhesive suitable for releasably securing the first and second film layers 14, 26. In an exemplary embodiment, the adhesive is an emulsion based acrylic. It will be recognized, however, that other types of adhesives could be used as well.

The first film layer 14 may be manufactured to bias the second panel section 42 in a direction away from the second film layer 26, as discussed above. This may be accomplished in various ways, such as by forming the first film layer 14 as a laminated film having tension induced in selected layers, such that the direction of curl of the second panel section 42 is controlled as desired; by coating the first film layer 14 with a material having shrinking properties; by applying a static charge to the first film layer 14; by co-extruding multiple layers and controlling the direction of curl by orienting the layers of the co-extruded film; or by other methods which cause the second panel section 42 to be biased in a desired direction.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

I claim:

1. A method of forming a tamper-indicating resealable closure, comprising:

forming a first tear line into a first film layer to define a first panel section for providing an access opening through the first film layer when separated from the first film layer, the first tear line arranged to facilitate separation of the first panel section from the first film layer;

forming a second tear line into the first film layer, adjacent the first tear line, to define a second panel section for indicating an initial opening of the closure; and releasably adhering a second film layer to the first film layer and covering the first and second panel sections such that the second film layer is separable from the first film layer by pulling the second film layer relative to the first film layer.

2. The method of claim 1, wherein forming the second tear line includes arranging the second tear line to leave a portion of the second panel section integrally joined to the first film layer.

3. The method of claim 2, wherein the second tear line has a generally elongated u-shape configuration defining a second panel in the first film layer, and the second panel having an end thereof remaining integrally joined to the first film layer.

4. The method of claim 3, wherein the second tear line further comprises a first and a second generally elongated u-shaped cuts, the first and the second generally elongated u-shape cuts providing a pair of tamper evident panels, the tamper evident panels each having an end integrally connected to the first film layer.

5. The method of claim 1, further comprising: separating the second film layer and the first panel section from the first film layer; separating the second panel section substantially from the first film layer; and separating the second panel section from the second film layer.

* * * * *